US010177513B1

(12) United States Patent
Glick et al.

(10) Patent No.: US 10,177,513 B1
(45) Date of Patent: Jan. 8, 2019

(54) BUS BAR ASSEMBLY WITH A SYSTEM TO FORM AND SECURE CONNECTIONS TO THE TERMINALS ON A BUS BAR

(71) Applicant: Lear Corporation, Southfield, MI (US)

(72) Inventors: Michael Glick, Farmington Hills, MI (US); Bhupinder Rangi, Novi, MI (US); David Menzies, Linden, MI (US); Lewis Galligan, Novi, MI (US); Imad Beydoun, Dearborn, MI (US)

(73) Assignee: LEAR Corporation, Southfield, MI (US)

( * ) Notice: Subject to any disclaimer, the term of this patent is extended or adjusted under 35 U.S.C. 154(b) by 0 days.

(21) Appl. No.: 15/856,136

(22) Filed: Dec. 28, 2017

(51) Int. Cl.
*H01R 25/16* (2006.01)
*H01R 13/428* (2006.01)

(52) U.S. Cl.
CPC ..... *H01R 25/165* (2013.01); *H01R 13/428* (2013.01); *H01R 25/162* (2013.01)

(58) Field of Classification Search
CPC .. H01R 25/165; H01R 13/428; H01R 25/162; H01R 25/16; H02B 1/20
USPC ..... 439/214, 212, 213, 110–122
See application file for complete search history.

(56) References Cited

U.S. PATENT DOCUMENTS 2,585,770 A * 2/1952 Hammerly ..... H02G 5/08 174/72 B
3,126,240 A * 3/1964 Christensen et al. .... H02G 5/08 174/99 B
3,219,887 A * 11/1965 Gerg ..... H02B 1/21 174/99 B
3,391,378 A 7/1968 Fisher
3,519,730 A * 7/1970 Hamilton, Jr. ..... H02G 5/007 174/88 B
3,683,313 A * 8/1972 Weimer ..... H02G 5/06 174/88 B
3,818,119 A 6/1974 Sutherland et al.
3,893,233 A 7/1975 Glover
4,758,172 A * 7/1988 Richards ..... H01R 25/14 174/72 B
4,886,468 A * 12/1989 Harton ..... H01R 25/161 174/68.2
5,196,987 A * 3/1993 Webber ..... H01R 25/16 361/624
5,619,014 A * 4/1997 Faulkner ..... H02G 5/007 174/129 B
6,142,807 A 11/2000 Faulkner
6,916,990 B2 7/2005 Behziz et al.
7,268,300 B2 9/2007 Miyazaki
7,967,622 B2 6/2011 Brütsch et al.

* cited by examiner

*Primary Examiner* — Tulsidas C Patel
*Assistant Examiner* — Travis Chambers
(74) *Attorney, Agent, or Firm* — MacMillan, Sobanski & Todd, LLC

(57) ABSTRACT

A bus bar includes a conductive portion with a first face and an opposed second face. The first face and second face extend between a first edge and a second edge. The bus bar includes an insulation surrounding the conductive portion. The insulation includes a cut out where a portion of the insulation is removed to expose a terminal on the bus bar. The terminal includes part of the first face of the bus bar and part of the second face of the bus bar. The terminal is located between the first edge and the second edge of the bus bar.

17 Claims, 11 Drawing Sheets

BUS BAR ASSEMBLY WITH A SYSTEM TO FORM AND SECURE CONNECTIONS TO THE TERMINALS ON A BUS BAR

BACKGROUND OF THE INVENTION

In electrical systems, a bus bar is adapted to act as a conductive connector between a power or signal source and various relays, circuit breakers, and other electronic connections. In conventional systems, the bus bar is often pre-formed with a variety of exposed protruding contacts at predetermined locations. For example, U.S. Pat. No. 7,268,300 shows a bus bar assembly that includes multiple bus bars with a plurality of terminals extending therefrom. U.S. Pat. No. 7,967,622 shows bus bars that have terminals extending therefrom. The bus bars are retained in an insulating bottom part and cover pieces that clip onto the bottom part. The cover includes partition walls that partially surround the terminals but allow access to the terminals. It would be advantageous to have an improved system to form and secure connections to the terminals on a bus bar.

SUMMARY OF THE INVENTION

This invention relates to a bus bar. The bus bar includes a conductive portion. The conductive portion has a first face and an opposed second face. The first face and second face extend between a first edge and a second edge. The bus bar includes an insulation surrounding the conductive portion. The insulation includes a cut out where a portion of the insulation is removed to expose a terminal on the bus bar. The terminal includes part of the first face of the bus bar and part of the second face of the bus bar. The terminal is located between the first edge and the second edge of the bus bar.

In another embodiment, the invention relates to an electrical header assembly. The electrical header assembly includes a header with a header shroud. The header shroud includes a plurality of shroud walls that define a terminal space. The header shroud is configured to mate with a corresponding connector. The header also includes an engagement portion. The engagement portion includes a first flange and a second flange. The engagement portion is configured to engage a bus bar. The header includes a bus bar space between the first flange and the second flange. The bus bar space extends from a mount end of the header into the terminal space.

In another embodiment, the invention relates to a bus bar assembly. The bus bar assembly includes a bus bar and a header. The bus bar includes an insulation with a cut out that exposes a terminal on the bus bar. The header includes a header shroud that defines a terminal space and a bus bar space that extends from a mate end of the heard into the terminal space. The bus bar is located in the bus bar space and extends into the terminal space of the header.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
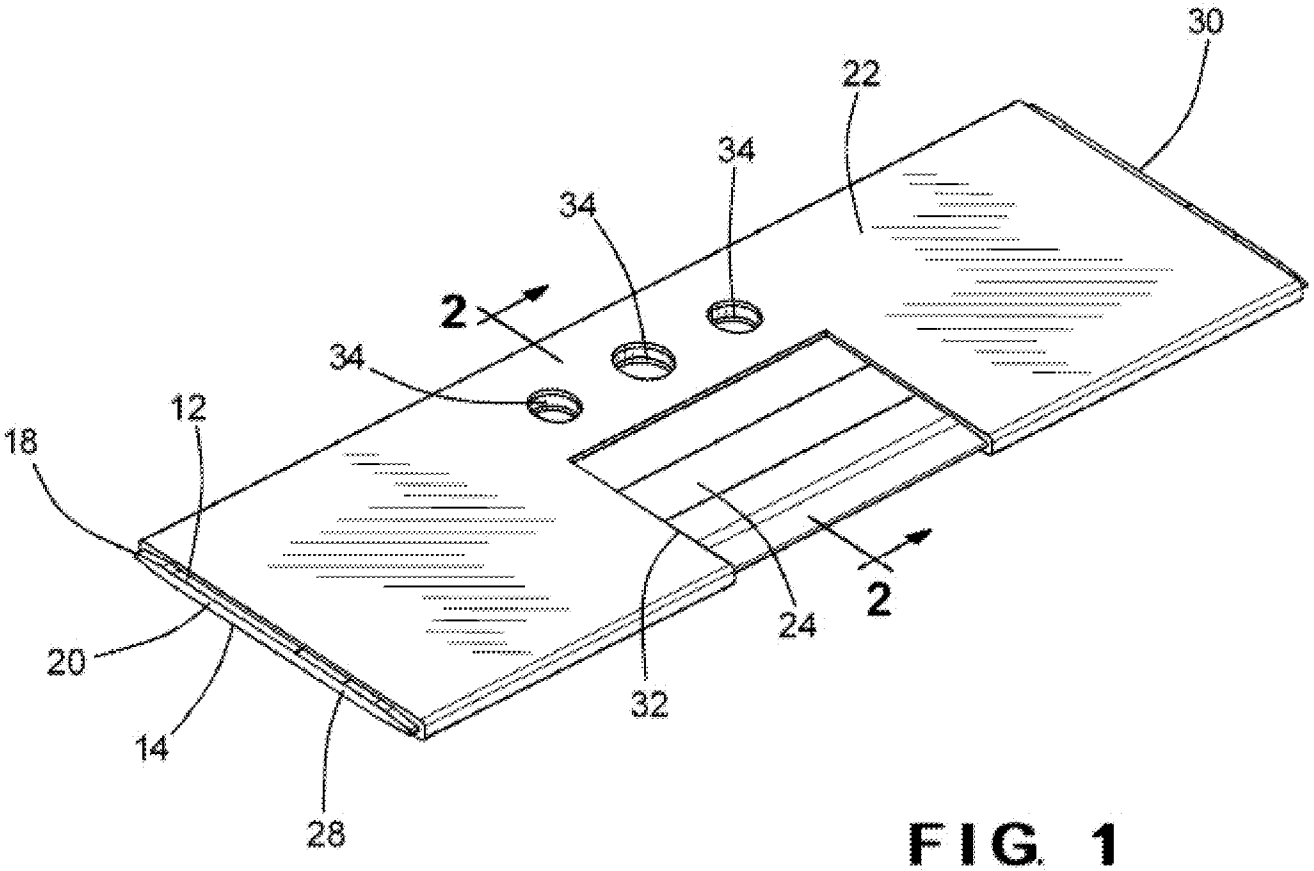
FIG. 1 is a perspective view of a bus bar including a terminal.
Figure 2:
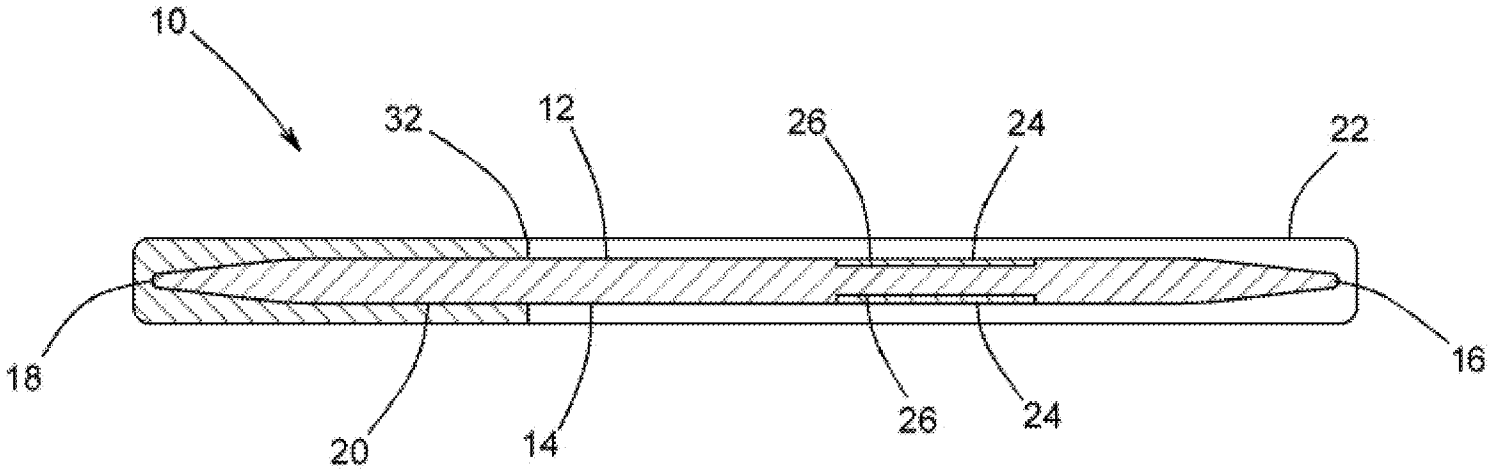
FIG. 2 is a cross-sectional view through the bus bar and terminal taken along the line 2-2 of FIG. 1.

Referring now to the drawings, there is illustrated in FIG. 1 a perspective view of a bus bar, indicated generally at 10 while FIG. 2 illustrates a cross-sectional view of the bus bar 10, taken along the line 2-2 of FIG. 1. The illustrated bus bar 10 has a generally rectangular cross-sectional shape, with a first face 12, a second face 14 that is opposed to the first face 12, and tapered sides forming a first edge 16 and a second edge 18 that is opposite the first edge 16. The illustrated bus bar 10 is a solid, rigid bus bar, but may be a flexible bus bar if desired. The illustrated bus bar 10 is an insulated bus bar and includes a conductive portion 20 surrounded by an electrical insulation 22. The illustrated conductive portion 20 is made of copper, but may be made of any desired material. The illustrated insulation 22 is an epoxy coating, but may be made of any desired material.

The illustrated bus bar 10 includes recessed portion 26 (shown in FIG. 2) on the first face 12 and the second face 14. Each recessed portion 26 includes a conductive inlay 24 located within the recessed portion 26. However, the bus bar 10 may have conductive inlays 24 located on only one face, multiple conductive inlays 24 located on each face, or no conductive inlays 24 at all. The illustrated conductive inlays 24 are made of silver, but may be made of any desired material. In the illustrated embodiment, the conductive inlays 24 have the same dimensions at the recessed portions 26 so that the conductive inlays 24 are flush with the first face 12 and the second face 14. However, the conductive inlays 24 may protrude or be recessed relative to the first face 12 and second face 14, if desired. In addition, the bus bar 10 may have recessed portions 26 without any conductive inlays 24. The illustrated bus bar 10 has the conductive inlays 24 and recessed portions 26 located off-center from a center line of the bus bar 10, and are located closer to the first edge 16 than the second edge 18. Further, the illustrated conductive inlay 24 and the recessed portion 26 located on the first face 12 are of the same dimensions and are spaced the same distance from the first edge 16 as the conductive inlay 24 and the recessed portion 26 located on the second face 14. However, the conductive inlays 24 and recessed portions 26 may be located at any point along the bus bar 10 or be offset relative to one another. In addition, the sizes of the conductive inlay 24 and/or the recessed portion 26 can be different relative to other respective conductive inlays 24 and/or recessed portions 26.

The illustrated insulation 22 is located on the first face 12, the second face 14, the first edge 16, and the second edge 18 of the bus bar 10. The bus bar 10 extends from a first end 28 to a second end 30, and the illustrated conductive portion 20 is not covered by the insulation 22 on either of the first end 28 or the second end 30. However, the insulation 22 may be located on any desired locations, including none, on the bus bar 10 (an uninsulated bus bar 10), or the entire surface of the bus bar 10 may be insulated. The illustrated bus bar 10 may be connected to any desired electrical components or electrical conductors (not shown) at the first end 28 and the second end 30.

The illustrated bus bar 10 and conductive inlays 24 extend linearly between the first end 28 and the second end 30. However, the bus bar 10 may have any desired shape between the first end 28 and the second end 30, and may include straight or curved portions if desired. In addition, the conductive inlays 24 may have any desired shape and may extend from the first end 28 to the second end 30 or may extend along only a portion of the bus bar 10.

The illustrated bus bar 10 also includes a cut out 32 where the insulation 22 is removed to expose a portion of the conductive portion 20 and the conductive inlays 24. In the illustrated embodiment, the cut out 32 is created by removing part of the insulation 22 by stripping. However, the insulation 22 may be removed by any desired mechanism or method, or the cut out 32 may be created by not placing any insulation 22 in desired locations during the installation of the insulation 22 on the bus bar 10. The illustrated bus bar 10 includes one cut out 32, but may include any desired number of cut outs 32. The illustrated cut out 32 extends predominately along the first face 12, the second face 14, and the first edge 16. However, the cut out 32 may be located on any desired face 12, 14 or edge 16, 18 of the bus bar 10, and may extend onto multiple faces 12, 14 and edges 16, 18 of the bus bar 10, if desired. In addition, the illustrated cut out 32 is sized to expose the conductive inlays 24 but could be sized to expose a portion or none of the conductive inlays 24.

The bus bar 10 includes header position assurance apertures 34. The illustrated bus bar 10 has three header position assurance apertures 34 formed as three cylindrical holes that are adjacent to the cut out 32 between the first edge 16 and the second edge 18, the purpose of which is further described below. The three cylindrical holes forming the header position assurance apertures 34 extend through the conductive portion 20 and the insulation 22 on both sides of the bus bar 10. However, the header position assurance apertures 34 may extend through any desired parts of the bus bar 10. Additionally, the bus bar 10 may include any number of cylindrical or other shaped openings forming the header position assurance apertures 34, or the bus bar 10 can be provided without any header position assurance apertures 34.

As best seen in FIG. 2, the illustrated bus bar 10 tapers to the first edge 16 and to the second edge 18. However, the bus bar 10 can have no tapered portions or only have one tapered portion. In addition, the first edge 16 or the second edge 18 can be square faces, angular faces, or have any desired shape. Further, the first edge 16 and the second edge 18 can be initially formed as a square or angular face, with a machining operation such as coining forming a tapered edge at the portion of the bus bar 10 corresponding to the cut out 32.

Figure 3:
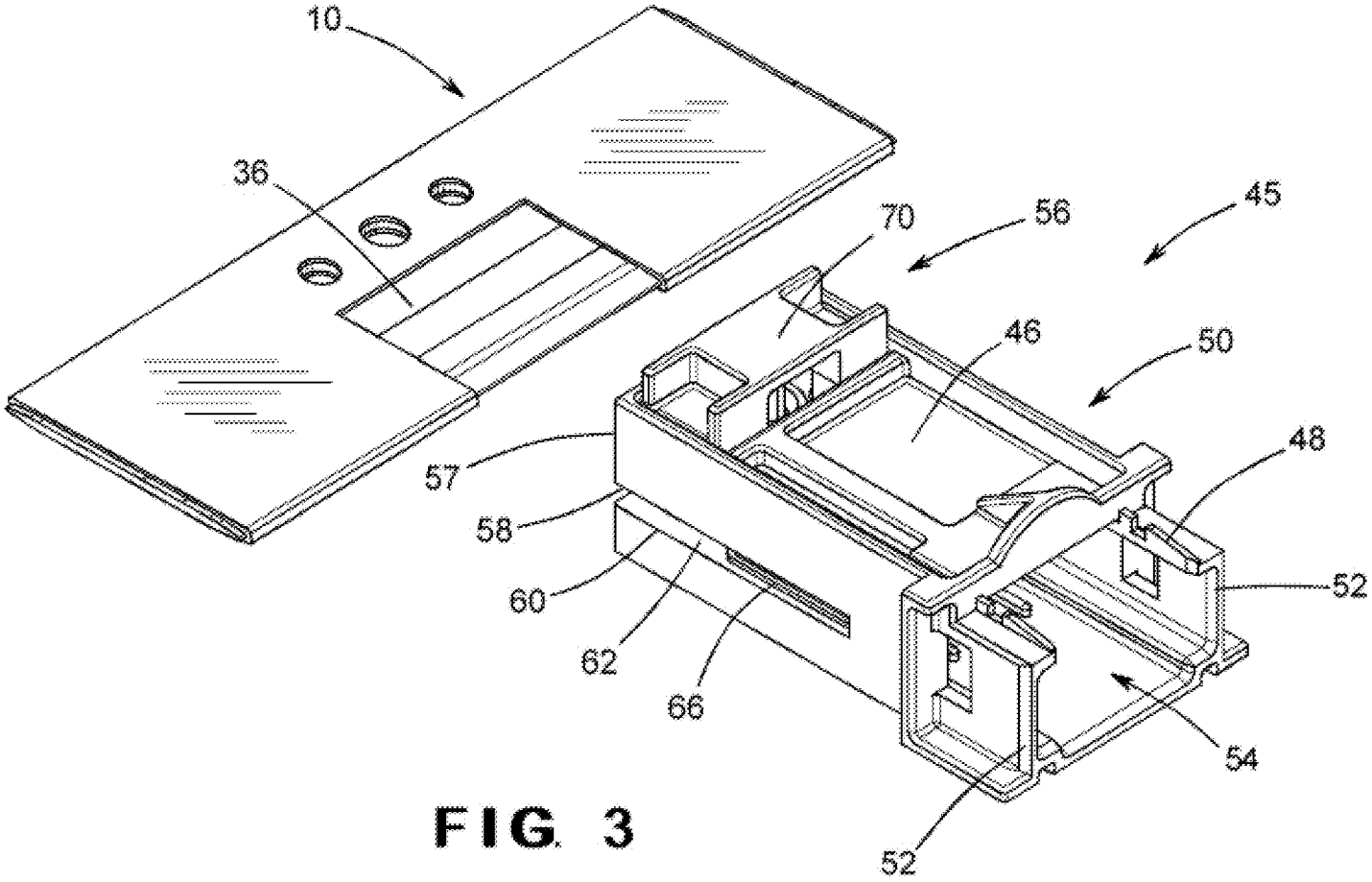
FIG. 3 is a perspective view of the bus bar illustrated in FIG. 1 and an unassembled header assembly.

Referring to FIG. 3, the bus bar 10 is illustrated with a header assembly 45 prior to attachment to the bus bar 10. The portion of the bus bar 10 in the cut out 32 forms a terminal 36 configured to be received in the header assembly 45 in order to mate with a corresponding terminal 94, as will be described below. In the illustrated embodiment, the terminal 36 is substantially formed from parts of the first face 12, the second face 14, the first edge 16, and the conductive inlays 24. However, the terminal 36 may be formed on any location on the bus bar 10 and may face in any desired direction. For example, a plurality of terminals 36 could be formed and oriented to include the first edge 16 or the second edge 18. It should be appreciated that the header assembly 45 receiving the terminal 36 on the first edge 16 would extend in an opposed direction to a second header assembly (not shown) receiving a second terminal (not shown) on the second edge 18. The illustrated terminal 36 is formed from the first face 12 and the second face 14 of the bus bar 10. The illustrated terminal 36 is located between the first edge 16 and the second edge 18 of the bus bar 10, and the first edge 16 of the bus bar 10 is located the same distance from the second edge 18 of the bus bar 10 as the terminal 36. It should be appreciated that if the first edge 16 of the bus bar 10 is machined to form an end of the terminal 36, then the first edge 16 of the bus bar 10 could be located farther from the second edge 18 of the bus bar 10 than the terminal 36.

Figure 7:
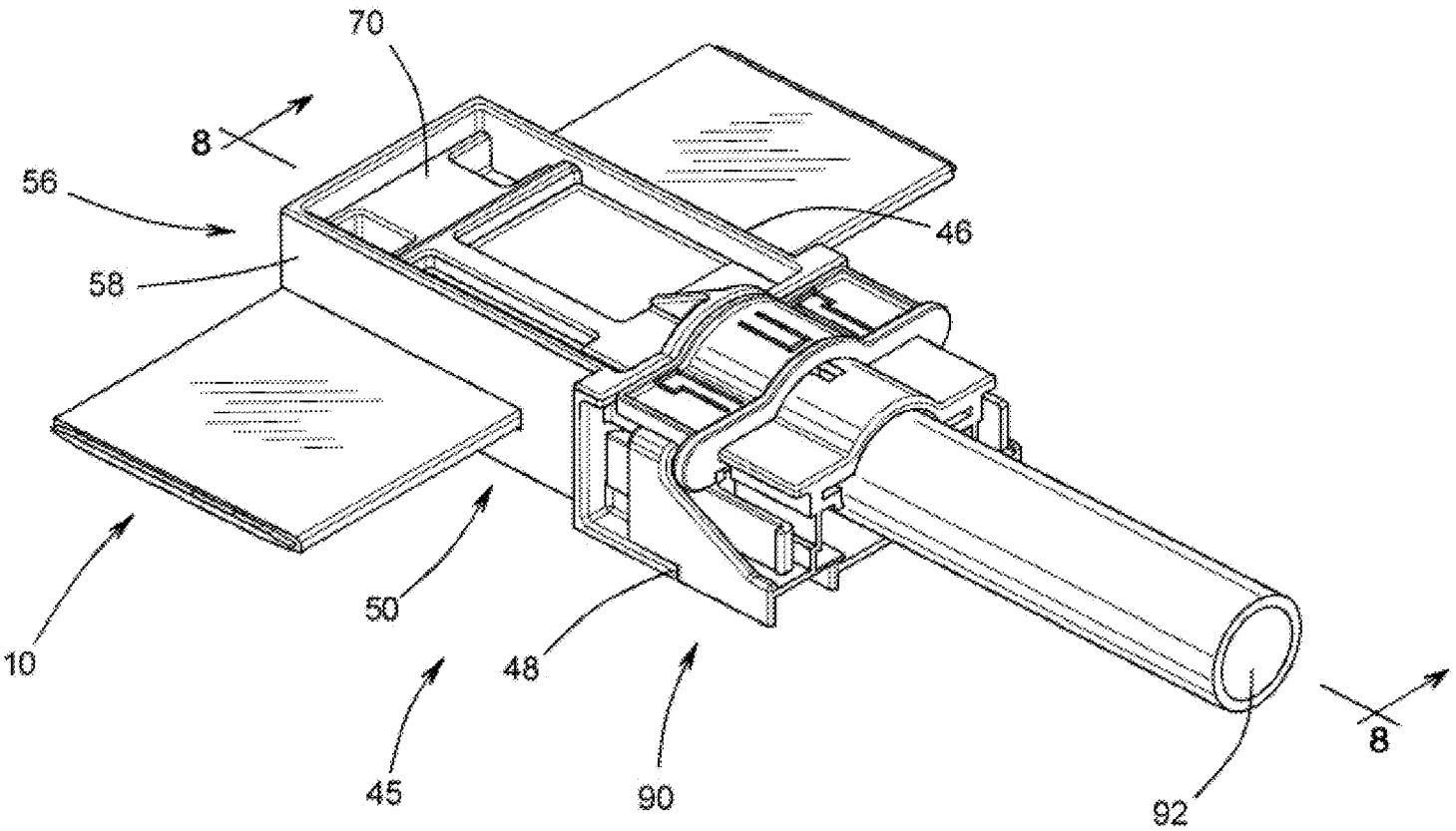
FIG. 7 is a perspective view of the bus bar assembly illustrated in FIG. 4 shown with a connector attached to the header assembly.

The illustrated header assembly 45 includes a header 46 and a header position assurance 70. The illustrated header 46 is made of plastic, but may be made of any desired material. The header 46 includes a header shroud, indicated generally at 50. The header shroud 50 includes a plurality of shroud walls 52 that define a terminal space, indicated generally at 54. The header shroud 50 includes a shroud opening 48 that opens into the terminal space 54. The header shroud 50 is configured to engage and mate with a corresponding connector 90, as shown in FIG. 7.

Figure 6:
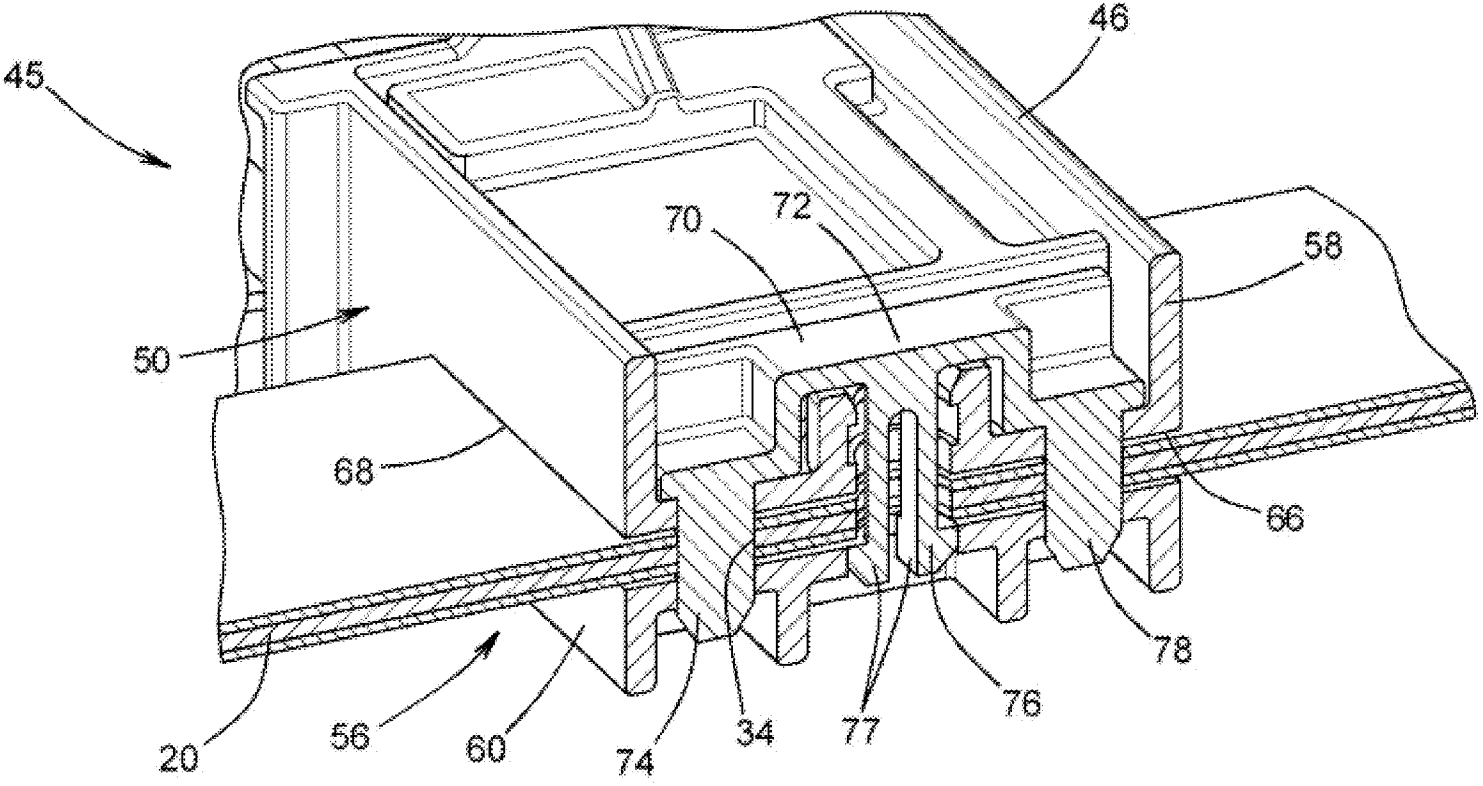
FIG. 6 is a perspective view of the bus bar and assembled header assembly from FIG. 4, taken from behind, cut away along the line 6-6 of FIG. 4.

As further seen in FIG. 3, the header 46 includes an engagement portion, indicated generally at 56. The illustrated engagement portion 56 extends from the header shroud 50 on the opposite side from the shroud opening 48 to a mount end 57, but may be located on any desired part of the header 46. As will be described below, the engagement portion 56 is configured to engage the bus bar 10. The illustrated engagement portion 56 includes a first flange 58 and a second flange 60 that extend substantially parallel to each other. A bus bar space 62 is defined between the first flange 58 and the second flange 60. The engagement portion 56 includes a first bus bar opening 66 that is located between the first flange 58 and the second flange 60 and is adjacent to the bus bar space 62. As seen in FIG. 6, the engagement portion 56 also includes a second bus bar opening 68 that is located between the first flange 58 and the second flange 60 and is adjacent to the bus bar space 62 on an opposite side of the bus bar space 62 from the first bus bar opening 66. The first bus bar opening 66 and the second bus bar opening 68 are located on opposed sides of the header 46, and the bus bar space 62 extends completely through the header 46. Additionally, the first bus bar opening 66 and the second bus bar opening 68 extend into two of the shroud walls 52 of the header shroud 50. As a result, the bus bar space 62 extends from the mount end 57 of the header 46 toward the shroud opening 48 and a portion of the bus bar space 62 is located within the terminal space.

Figure 4:
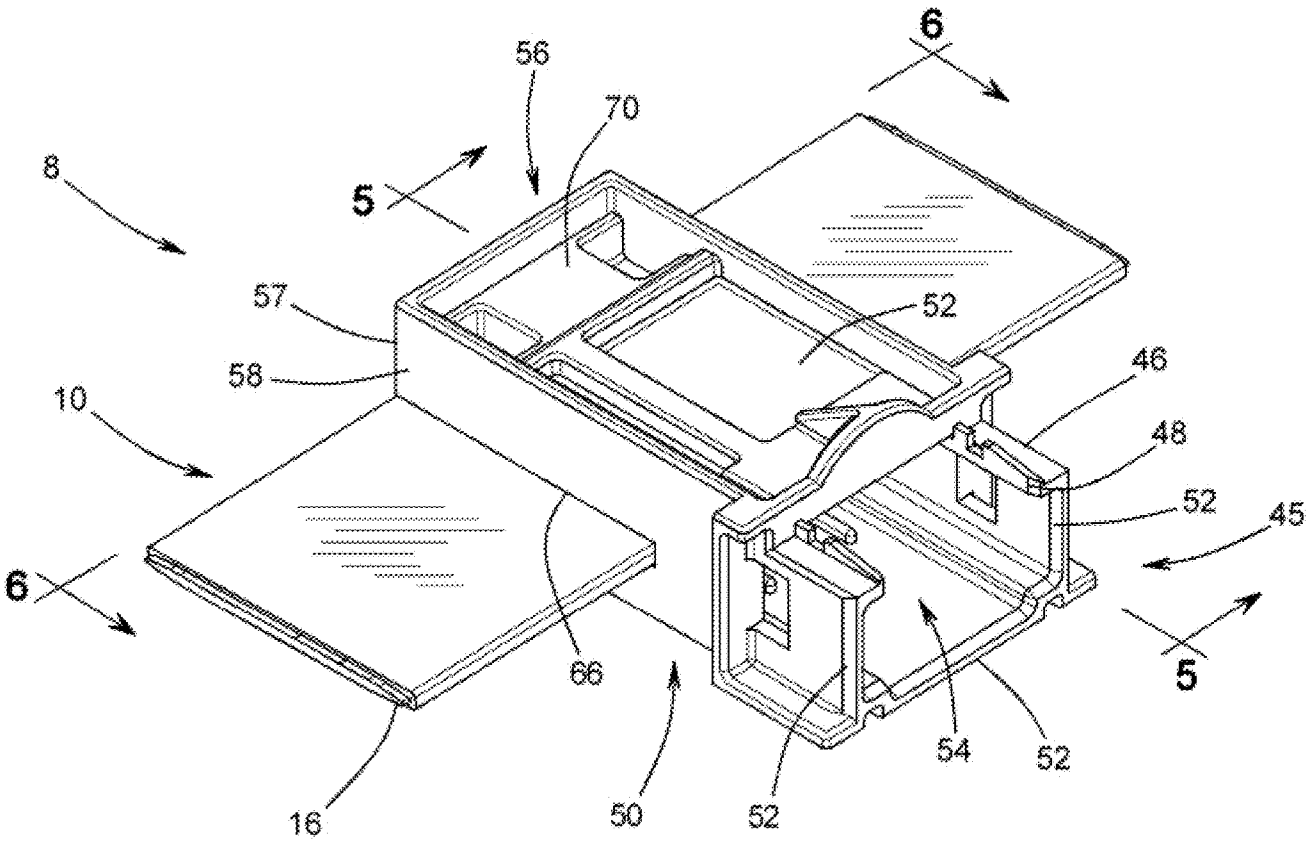
FIG. 4 is a view similar to FIG. 3 showing the header assembly attached to the bus bar.
Figure 5:
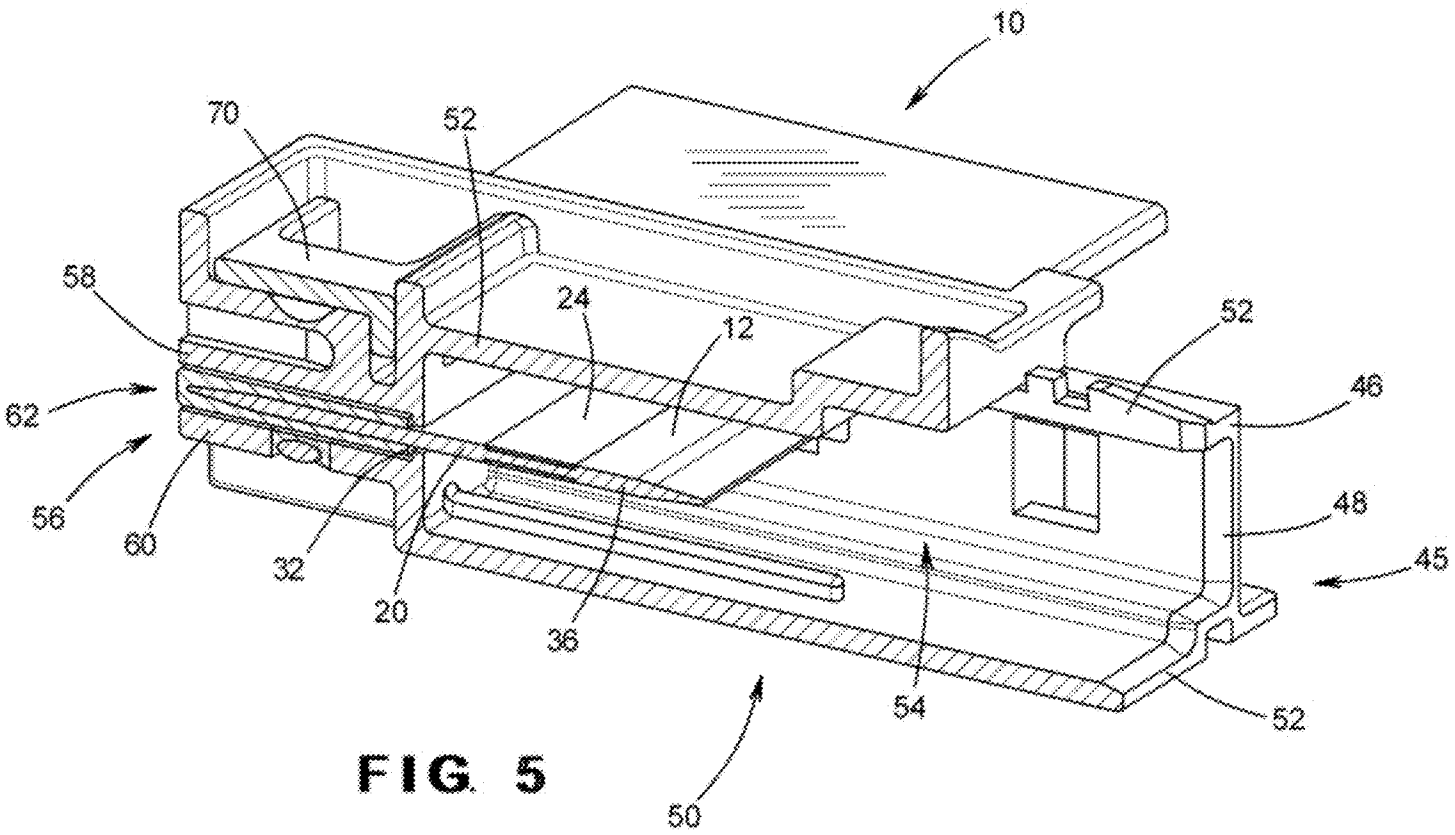
FIG. 5 is view similar to FIG. 4 showing the bus bar and header assembly cut-away along the line 5-5 of FIG. 4.

Referring now to FIG. 4, there is illustrated a view similar to FIG. 3, showing the header assembly 45 attached to the bus bar 10 to form a bus bar assembly 8. FIG. 5 is a view similar to FIG. 4, showing the bus bar assembly 8 cut away along the line 5-5 of FIG. 4. The header 46 is configured to be attached to the bus bar 10 by positioning a portion of the bus bar 10 in the bus bar space 62. In order to attach the header 46 to the bus bar 10, the header 46 is positioned with the mount end 57 facing the first edge 16 of the bus bar 10. The header 46 is moved relative to the bus bar 10 so that the first edge 16 of the bus bar 10 enters the bus bar space 62. The first flange 58 of the header 46 is located adjacent to and is engaged with the insulation 22 on the first face 12 of the bus bar 10, and the second flange 60 of the header is located adjacent to and is engaged with the insulation 22 on the second face 14 of the bus bar 10. It should be appreciated that the bus bar space 62 passes completely through the header 46 in order to allow the bus bar 10 to extend out both sides of the header 46. The header 46 is moved relative to the bus bar 10 to an installed position, wherein the terminal 36 on the bus bar 10 is located in the terminal space 54 of the header 46. With the header 46 in the installed position, a portion of the bus bar 10 passes through the shroud walls 52 and through the terminal space 54 of the header 46.

When the bus bar 10 and the header assembly 45 are joined together to form the bus bar assembly 8, the terminal 36 is located in the terminal space 54 between the plurality of shroud walls 52. As previously described, when the header 46 is in the installed position, the first flange 58 and the second flange 60 are engaged with the insulation 22 on the bus bar 10. Also, as seen in FIGS. 4 and 6, the shroud walls 52 are engaged with the insulation 22 on the bus bar 10 where bus bar openings 66 and 68 extend into the shroud walls 52. This engagement retains the header 46 in position relative to the bus bar 10 due to frictional forces between the insulation 22 and the header 46. Additionally, the engagement prevents dust or fluid from passing between the bus bar 10 and the header 46 into the terminal space 54. If desired, a seal (not shown), may be placed adjacent the cut out 32 in interface with the header assembly 45 to further prevent an ingress of dust or fluid.

As shown in FIG. 4, the header assembly 45 encompasses the terminal 36 such that the entire terminal 36 is located between the first bus bar opening 66 and the second bus bar opening 68. The first edge 16 of the bus bar 10 is located in the first and second bus bar openings 66 and 68 that extend into the shroud walls 52. Further, the shroud walls 52 extend farther from the mount end 57 to the shroud opening 48 than the bus bar 10. As a result, the header 46 surrounds the terminal 36 and prevents contact with the terminal except through the shroud opening 48.

With the header 46 in the installed position on the bus bar 10, the header position assurance 70 serves as a secondary lock to retain the header 46 on the bus bar 10 and to ensure that the header 46 is properly positioned on the bus bar 10. The illustrated header position assurance 70 is made of plastic, but may be made of any desired material. The illustrated header position assurance 70 is located on engagement portion 56 of the header 46, but may be located in any desired position. The illustrated header position assurance 70 is mounted on the header 46 for relative movement, and may be supported on the header in a retracted position shown in FIG. 3. As illustrated in FIG. 6, the header position assurance 70 includes a header position assurance base 72. A first header position assurance arm 74, a second header position assurance arm 76, and a third header position assurance arm 78 extend from the header position assurance base 72. The illustrated header position assurance arms 74, 76, and 78 are generally cylindrical extensions that extend from the header position assurance base 72, but may have any desired shape. The header position assurance arms 74, 76, and 78 are shaped and configured to be received in the header position assurance apertures 34. The illustrated second header position assurance arm 76 comprises a pair of resilient protuberances 77 that are configured to be displaced when initially inserted into a header position assurance aperture 34.

When the header 46 is in the installed position on the bus bar 10, the illustrated header position assurance 70 is moved relative to the header 46 toward the bus bar 10 such that header position assurance arms 74, 76, and 78 pass through the header position assurance apertures 34. The resilient protuberances 77 on the header position assurance arm 76 deflect and rebound to engage the second face 18 of the bus bar 10, in order to retain the header position assurance 70 in position relative to the bus bar 10. The header position assurance 70 in this position, prevents movement of the header 46 relative to the bus bar 10 and also functions as an indicator that the header 46 has sufficiently engaged the bus bar 10. It should be appreciated that if the header 46 is not properly positioned relative to the bus bar 10, then the header position assurance arms 74, 76, and 78 will not pass through the header position assurance apertures 34 which will indicate that the header 46 is not in the installed position on the bus bar 10. Although one specific embodiment of the header position assurance 70 has been described in detail, the header position assurance 70 can be any desired retainer or retaining mechanism. It is further within the scope of the invention that the header assembly 45 can lack a header position assurance 70.

Figure 8:
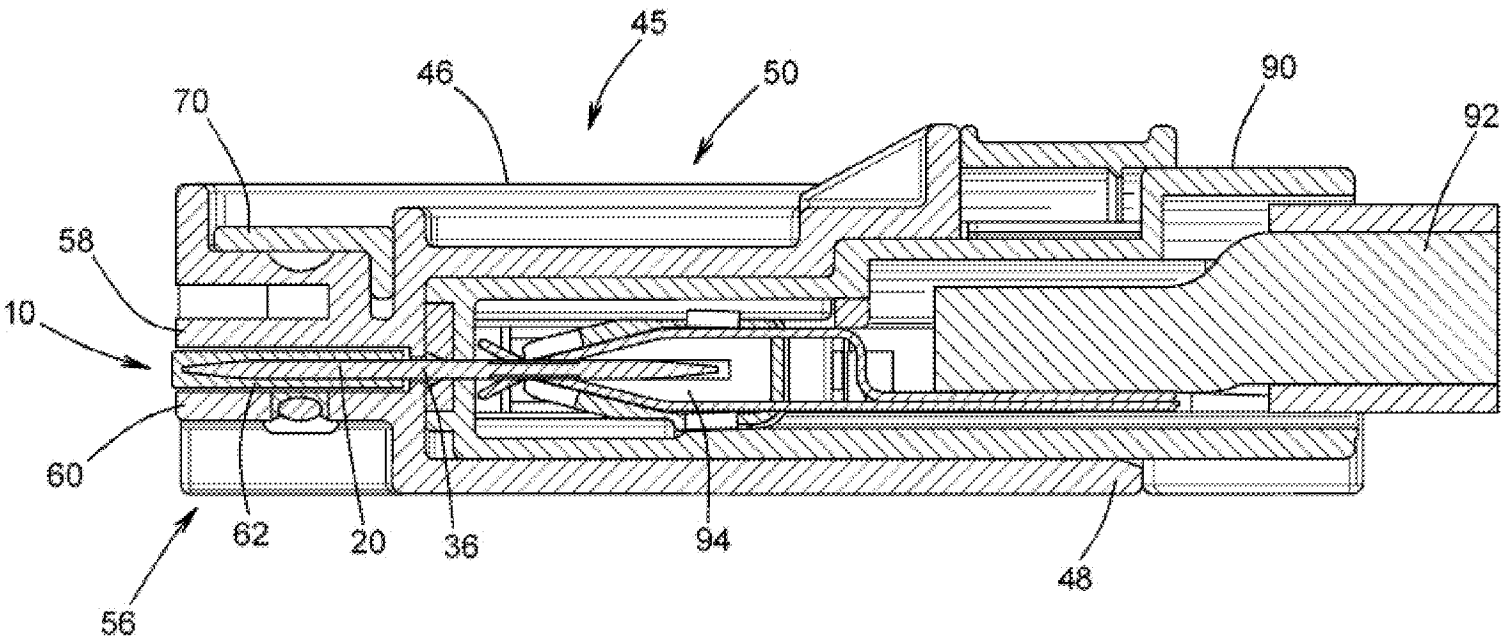
FIG. 8 is a cross-sectional view taken along the line 8-8 of FIG. 7.

Referring to FIG. 7, a view of the bus bar assembly 8 similar to FIG. 4 is illustrated with a corresponding connector 90 connected to the header assembly 45. FIG. 8 is a cross-sectional view of the bus bar assembly 8 and corresponding connector 90 taken along the line 8-8 of FIG. 7. The corresponding connector 90 is attached to an electrical conductor 92 which is attached to a corresponding terminal 94, as best shown in FIG. 8, housed in the connector 90. The illustrated electrical conductor 92 is an insulated wire, but may be any desired electrical conductor or component. The illustrated corresponding terminal 94 is a female, spring-assisted electrical terminal, but may be any desired type of terminal. As shown in FIG. 8, when the corresponding connector 90 is mated with the header assembly 45, the corresponding terminal 94 is mated with the terminal 36 on the bus bar 10. In the illustrated embodiment, the corresponding terminal 94 engages the conductive inlay 24. Thus, an electrical connection is established between the bus bar 10 and the electrical conductor 92.

Figure 9:
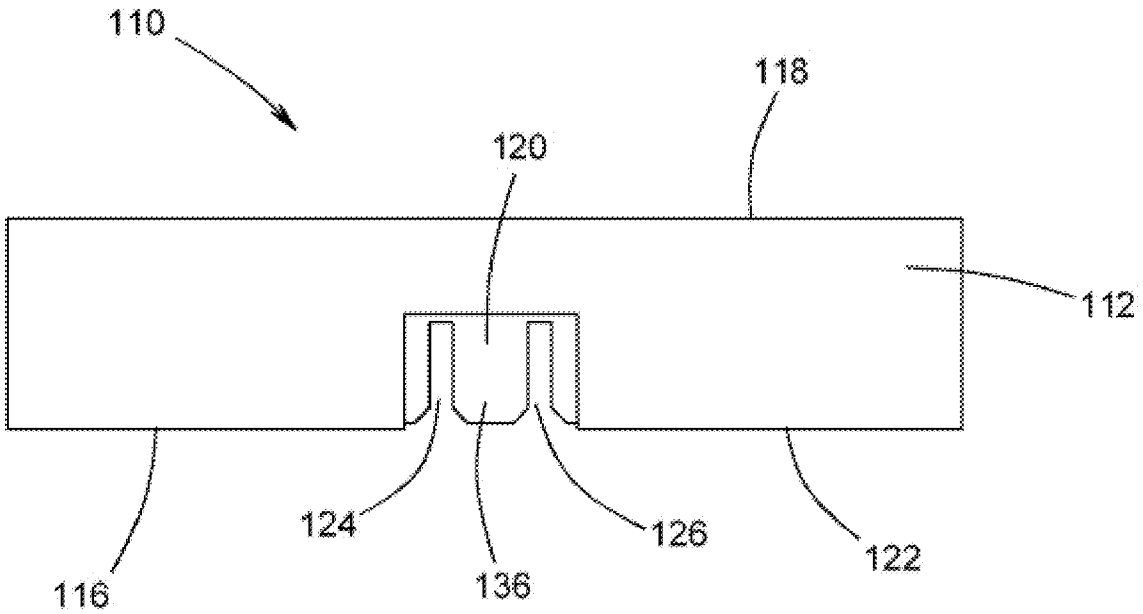
FIG. 9 is a top view of an alternate embodiment of a bus bar including a terminal.

Referring now to FIG. 9, an alternate embodiment of a bus bar 110 with a terminal 136 is shown. The bus bar 110 has a generally rectangular cross-sectional shape, with a first face 112, a second face 114 (shown in FIG. 11) that is opposed to the first face 112, and sides forming a first edge 116 and a second edge 118 that is opposed the first edge 116. The illustrated bus bar 110 is a solid, rigid bus bar, but may be a flexible bus bar if desired. The illustrated bus bar 110 includes a conductive portion 120. The illustrated conductive portion 120 is made of copper, but may be made of any desired material. The bus bar 110 includes an outer layer of insulation 122, similar to the insulation 22 on the previously-described bus bar 10.

In addition, the illustrated bus bar 110 includes a terminal 136 in the conductive portion 120 of the bus bar 110, which is formed by removing material from the conductive portion 120. As illustrated, a first opening 124 and a second opening 126, extend from the first edge 116 and into the conductive portion 120 of the bus bar. The illustrated first and second openings 124 and 126 are spaced apart and generally parallel relative to one another, but can be at any orientation. The insulation 122 is removed from the part of the conductive portion 120 located between the first opening 124 and the second opening 126, in order to create the terminal 136. The illustrated terminal 136 is formed from the first face 112 and the second face 114 of the bus bar 110. The illustrated terminal 136 is located between the first edge 116 and the second edge 118 of the bus bar 110, and the first edge 116 of the bus bar 110 is located the same distance from the second edge 118 of the bus bar 110 as the terminal 136. It should be appreciated that if the first edge 116 of the bus bar 110 is machined to form an end of the terminal 136, then the first edge 116 of the bus bar 110 could be located farther from the second edge 118 of the bus bar 110 than the terminal 136.

Figure 10:
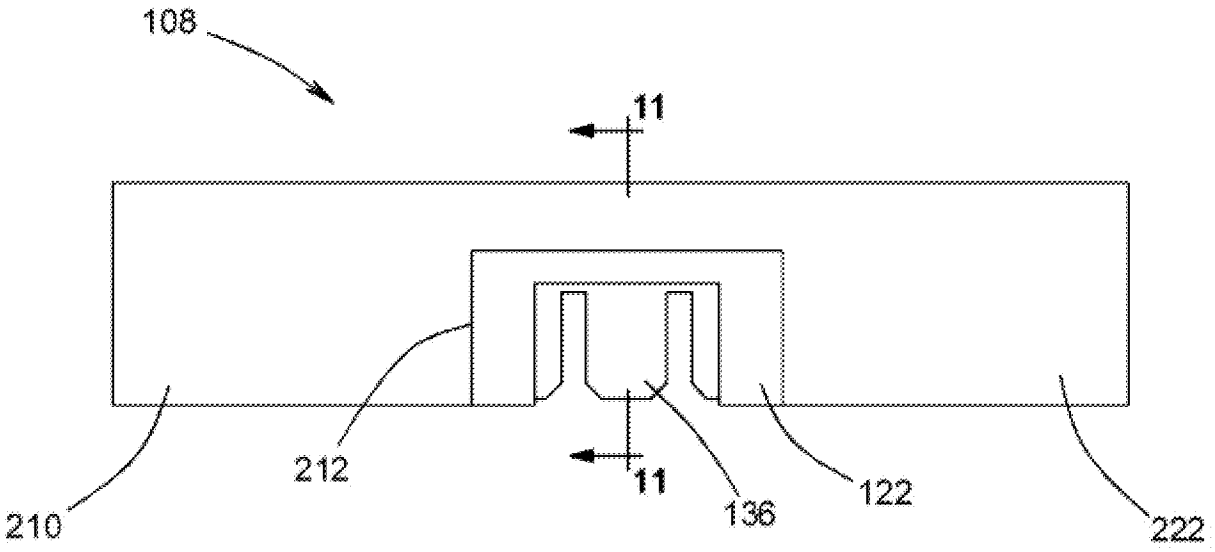
FIG. 10 is a top view of the bus bar from FIG. 9 shown in a stacked configuration with additional bus bars.
Figure 11:
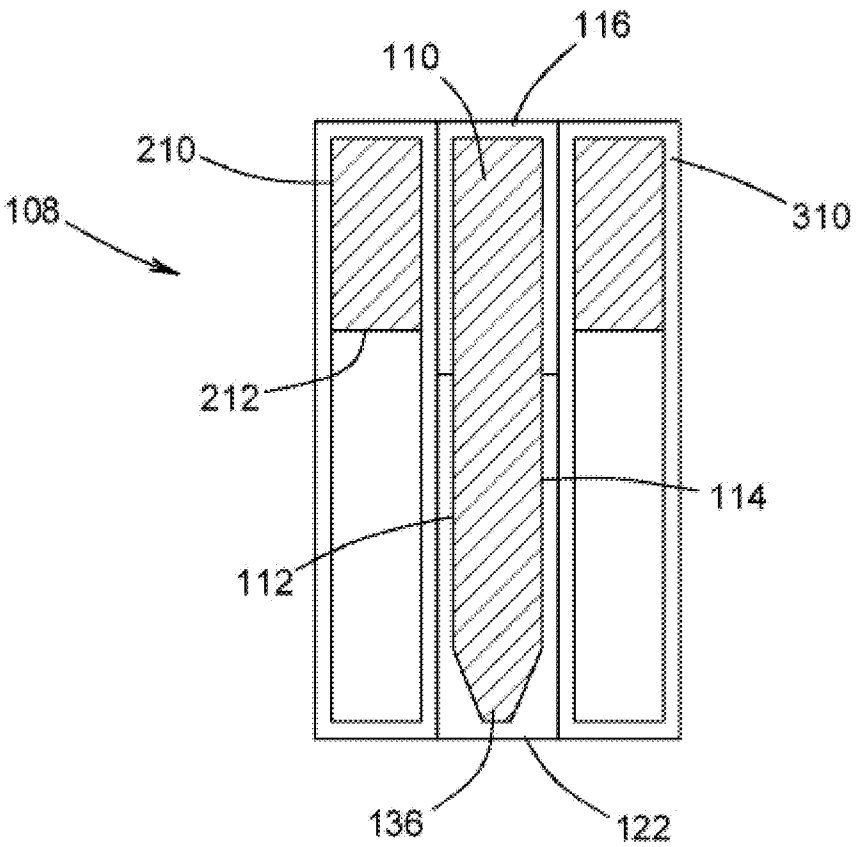
FIG. 11 is a cross-sectional view taken along the line 11-11 of FIG. 10.

Referring to FIG. 10, there is illustrated a plan view of a bus bar assembly 108 that includes the bus bar 110. FIG. 11 illustrates a cross-sectional view of the bus bar assembly 108, taken along the line 11-11 of FIG. 10. The bus bar assembly 108 includes a second bus bar 210 and a third bus bar 310 that have similar dimensions to the bus bar 110 and are in a stacked configuration with the bus bar 110. The second bus bar 210 is adjacent the first face 112 of the bus bar 110 and the third bus bar 310 is adjacent the second face 114 of the bus bar 110. The bus bar 110 the second bus bar 210, and third bus bar 310 are illustrated as extending parallel relative to each other and with their respective edges aligned. Although they will not be described in detail, it should be appreciated that the second bus bar 210 and the third bus bar 310 include respective conductive portions 220 and 330, and respective insulation layers 222 and 322.

In order to facilitate access to the terminal 136 on the bus bar 110, the second bus bar 210 includes a gap 212. The gap 212 is an area adjacent to the first face 112 of the bus bar 110 where the conductive portion 220 and the insulation 222 of the second bus bar 210 have been removed. The illustrated gap 212 has a generally rectangular shape, but may have any desired shape. The gap 212 is sized and positioned so that no part of the second bus bar 210 is located adjacent to the terminal 136, the first opening 124, and the second opening 126. Similarly, the third bus bar 310 includes a gap 312. The gap 312 is an area adjacent to the second face 114 of the bus bar 110 where the conductive portion 320 and the insulation 322 of the third bus bar 310 have been removed. The gap 312 on the third bus bar 310 is only visible in FIG. 11, but it should be appreciated that the gap 312 has a generally rectangular shape and is sized and positioned so that no part of the third bus bar 310 is located adjacent to the terminal 136, the first opening 124, and the second opening 126.

While the illustrated embodiment of the bus bar assembly 108 includes three bus bars 110, 210, and 310, any desired number of bus bars can be utilized to form the bus bar assembly 108.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A bus bar comprising:

a conductive portion with a first face and an opposed second face, the first face and second faces extending between a first edge and a second edge; and an insulation surrounding the conductive portion, the insulation including a cut out where a portion of the insulation is removed to expose a terminal on the bus bar, the terminal including part of the first face of the bus bar and part of the second face of the bus bar and being located between the first edge and the second edge of the bus bar, wherein the bus bar further comprises either:

(1) a recessed portion in the first face of the bus bar that includes a conductive inlay, wherein the conductive inlay is located in the terminal; or (2) a first opening that extends from the first edge of the bus bar toward the second edge of the bus bar and a second opening that extends from the first edge of the bus bar toward the second edge of the bus bar, wherein the first opening and the second opening are located on opposed sides of the terminal.

2. The bus bar of claim 1, further comprising a recessed portion in the first face of the bus bar that includes a conductive inlay, wherein the conductive inlay is located in the terminal.

3. The bus bar of claim 2, further comprising a second recessed portion in the second face of the bus bar that includes a second conductive inlay, wherein the second conductive inlay is located in the terminal.

4. The bus bar of claim 1, further comprising a first opening that extends from the first edge of the bus bar toward the second edge of the bus bar and a second opening that extends from the first edge of the bus bar toward the second edge of the bus bar, wherein the first opening and the second opening are located on opposed sides of the terminal.

5. The bus bar of claim 4, wherein the first opening and the second opening define respective sides of the terminal.

6. An electrical header assembly comprising:

a header including (1) a header shroud that includes a plurality of shroud walls defining a terminal space, the header shroud configured to mate with a corresponding connector, (2) an engagement portion that includes a first flange and a second flange, the engagement portion configured to engage a bus bar, and (3) a bus bar space between the first flange and the second flange that extends from a mount end of the header into the terminal space; and a header position assurance that extends between the first flange and the second flange, wherein the header position assurance includes a header position assurance base and at least one header position assurance arm.

7. The electrical header assembly of claim 6, wherein the bus bar space extends between a first bus bar opening and a second bus bar opening located on opposed sides of the header, the first bus bar opening extends into one of the plurality of shroud walls, and the second bus bar opening extends into another of the plurality of shroud walls.

8. The electrical header assembly of claim 6, wherein the at least one header position assurance arm extends between the first flange and the second flange.

9. A bus bar assembly comprising:

a bus bar comprising;

a conductive portion with a first face and an opposed second face, the first face and second face extending between a first edge and a second edge;

an insulation surrounding the conductive portion, the insulation including a cut out where a portion of the insulation is removed to expose a terminal on the bus bar, the terminal including part of the first face of the bus bar and part of the second face of the bus bar and being located between the first edge and the second edge of the bus bar; and a header engaged with the bus bar comprising;

a header shroud that includes a plurality of shroud walls defining a terminal space; and an engagement portion that includes a first flange that is engaged with the first face of the bus bar and a second flange that is engaged with the second face of the bus bar, the bus bar extending from a mount end of the header and into the terminal space, wherein either:

(1) the first flange and the second flange engage the insulation; or (2) first and second ones of the plurality of shroud walls engage the insulation.

10. The bus bar assembly of claim 9, wherein a bus bar space extends between a first bus bar opening and a second bus bar opening located on opposed sides of the header, and wherein the first bus bar opening extends into the first one of the plurality of shroud walls and the second bus bar opening extends into the second one of the plurality of shroud walls.

11. The bus bar assembly of claim 10, wherein the bus bar extends through the first bus bar opening and the second bus bar opening.

12. The bus bar assembly of claim 11, wherein the terminal is located in the terminal space.

13. The bus bar assembly of claim 10, wherein the first flange and the second flange engage the insulation.

14. The bus bar assembly of claim 13, wherein the first one of the plurality of shroud walls and the second one of the plurality of shroud walls engage the insulation.

15. The bus bar assembly of claim 9, wherein the header shroud is configured to mate with a corresponding connector.

16. The bus bar assembly of claim 9, further comprising a header position assurance that extends between the first flange and the second flange.

17. The bus bar assembly of claim 16, wherein the header position assurance includes a header position assurance base and at least one header position assurance arm that extends through an aperture in the bus bar.

* * * * *